US006050438A

United States Patent [19]

Kovens et al.

[11] Patent Number: 6,050,438

[45] **Date of Patent: *Apr. 18, 2000**

[54] SPHERICAL DISPENSING CAPSULE

[75] Inventors: Brian S. Kovens, Reisterstown; Raymond J. Pendyck, Ellicott City, both of Md.

[73] Assignee: Parkway Machine Corporation, Timonium, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,598

[22] Filed: Dec. 27, 1996

Related U.S. Application Data

[63] Continuation-in-part of application No. 29/056,354, Jun. 27, 1996.

[51] Int. Cl.[7] ..... B65D 45/22

[52] U.S. Cl. ..... 220/4.24; 220/4.25; 220/796; 220/801

[58] Field of Search ..... 220/4.24, 4.25, 220/796, 799, 801, 805

[56] References Cited

U.S. PATENT DOCUMENTS

| | | | |
|---|---|---|---|
| 911,051 | 2/1909 | Bourgeois | 220/4.25 |
| 1,141,625 | 6/1915 | Gardner | 220/796 |
| 2,549,644 | 4/1951 | Silverman | 220/4.24 |
| 2,606,708 | 8/1952 | Irvan | 220/796 |
| 2,745,642 | 5/1956 | Hermann . | |
| 2,784,512 | 3/1957 | Goodwin | 220/4.25 |
| 3,000,022 | 9/1961 | Cathey et al. | 220/4.25 |
| 3,258,115 | 6/1966 | Kath | 220/801 |
| 3,285,408 | 11/1966 | Carnaghi et al. | 220/801 |
| 3,945,568 | 3/1976 | Bychowski | 220/4.25 |
| 4,103,774 | 8/1978 | Shingyouchi | 220/4.25 |
| 4,106,657 | 8/1978 | Dogliotti | 220/4.25 |
| 4,124,135 | 11/1978 | Weder et al. | 220/4.25 |
| 4,765,501 | 8/1988 | Kao | 220/4.21 |
| 5,605,646 | 2/1997 | Colombo et al. | 249/134 |
| 5,792,496 | 8/1998 | Fekete et al. | 426/104 |
| 5,988,424 | 11/1999 | Kovens | 220/259 |

FOREIGN PATENT DOCUMENTS

| | | | |
|---|---|---|---|
| 1 371 240 | 7/1964 | France | 220/4.25 |

OTHER PUBLICATIONS

Excerpt from 1993 Parkway Machine Corporation Catalogue (pp. 14–15) No Author.

Excerpt from new 1996 Parkway Machine Corporation Catalogue No Page No No Date.

*Primary Examiner*—Stephen Castellano

*Attorney, Agent, or Firm*—Cahn & Samuels, LLP

[57] ABSTRACT

A generally spherical, bifurcated capsule for containing a discrete article or articles being capable of non-destructive separation and including cooperating mating elements providing a strong interference fit which is particularly suited for use in bulk vending machines.

9 Claims, 2 Drawing Sheets

FIG. 4
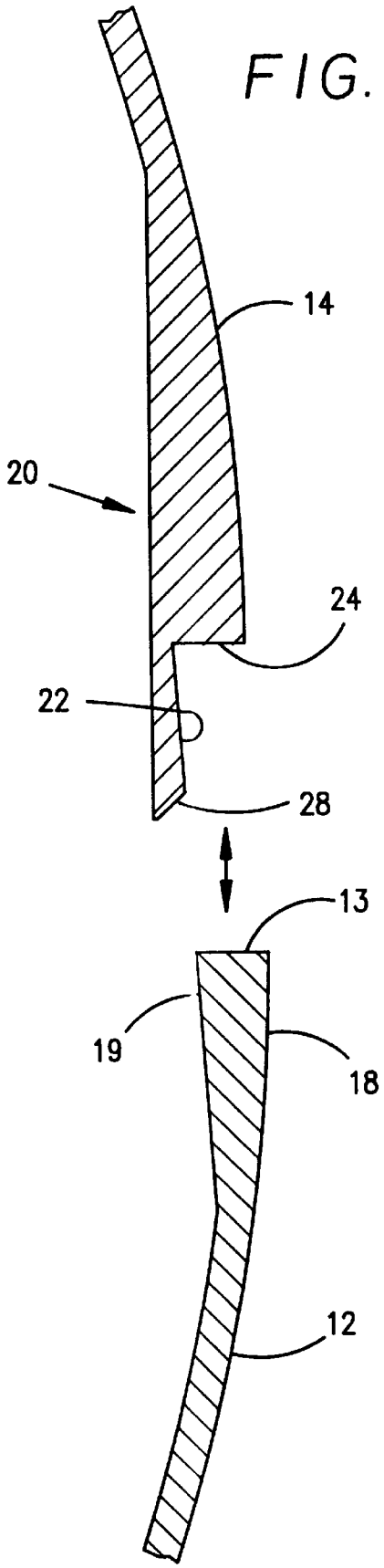
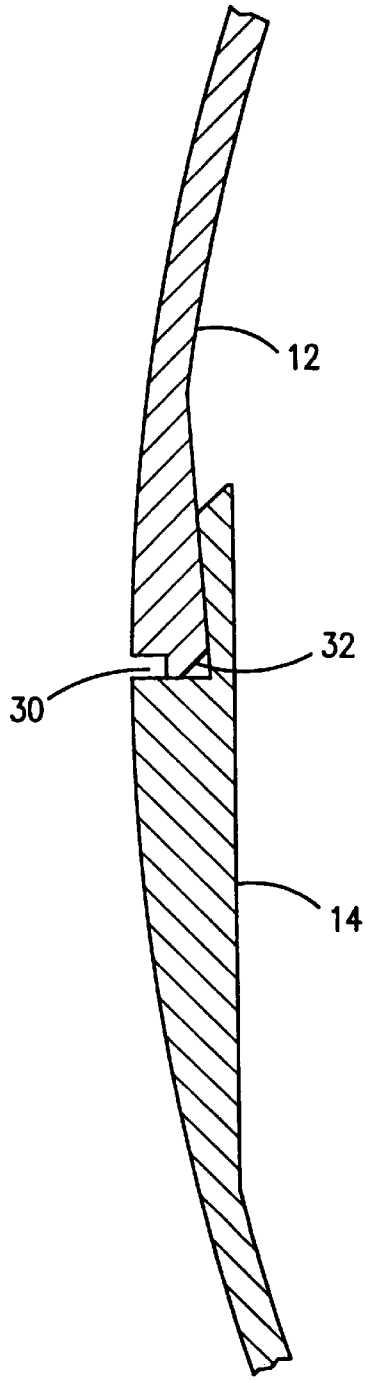
FIG. 5

SPHERICAL DISPENSING CAPSULE

RELATED APPLICATION

This is a continuation-in-part application to U.S. Design patent application Ser. No. 29/056,354 filed Jun. 27, 1996.

TECHNICAL FIELD

The present invention is directed to improvements in dispensing capsules, and particularly for item dispensing capsules for use in vending machines. The inventive spherical capsule disclosed herein provides a useful adjunct to dispensing operations having a spherical periphery, dimensional uniformity, and structural integrity to promote consistency for improving dispensability and to reduce concern about the capsule orientation in the vending machine.

BACKGROUND OF THE INVENTION

Many articles are stored and offered for sale today are sold in synthetic resin containers. The form and composition of such containers varies. Typically, it is desirable to provide a relatively secure closure to withstand the intended storage environment. However, many modern packages either fail to meet this objective or are of limited utility.

In addition to many different shapes, containers are found to be formed from a number of different materials such as polyolefins, polystyrenes, polyacrylics, polyesters, polyethers, blends and copolymers thereof. Containers may also be formed of environmentally friendly materials such as recycled plastics or renewable cellulose composites.

In many instances the desired properties of the final package in its intend storage/dispensing environment, e.g. rigidity and strength, control the selection of materials and fabrication techniques. Common fabrication techniques include injection molding, blow molding, and stamping.

One common container form now employed in both vending applications and point of sale displays are plastic "eggs" formed by injection molding of a plastic possessing sufficient rigidity to provide a protective "shell". One example of prominent use of such containers is in the hosiery field. It is not uncommon to find hosiery packaged in appropriately sized and colored eggs.

In the bulk vending arts, capsules are often used to dispense small toys or measured amounts of confectioneries. In such uses, it is necessary that the capsule be sized to be compatible with the dispensing mechanism of the vending machine. Such capsules are typically rigid and provide a standardized peripheral configuration for otherwise irregularly shaped articles. Thus, such articles which would not otherwise be dispensable from the bulk vending machines can be so dispensed.

Lacking standard size, without the shell provided by dispensing capsules, many products would be excluded from the coin operated bulk vending field because a single machine is not be able to accommodate the wide range of irregular configurations of items typically subject to dispensing from such vending machines, e.g., candy, nuts, toys, rings, decals, etc. Conventional capsules now in use define a non-spherical, irregular periphery. These capsule allow for a product to pass through a typical bulk vending machine, which, for example, features an uppermost storage globe, an intermediate hopper housing a rotatable merchandise wheel for dispensing discrete units to an underlying discharge chute. The most common capsule forms now employed are oblong, elliptical, or somewhat hemispherical. As such, the irregular shell generally requires a greater volume than would more uniformly shaped capsules.

The need for capsules in bulk vending is particularly acute when dispensing irregularly and non-uniformly shaped articles. Without the outer shell, such articles would because frictionally engage and jam in and bind the rotating merchandise wheel within a hopper. Thus, the machine is unable to perform its intended function. By sealing such articles within a plastic dispensing "egg" the prospect of such jamming is reduced by providing smooth translation of the merchandise container from the storage hopper, through the merchandise wheel, to the dispensing chute.

Typically, the "egg" shaped containers have an oval/oblong appearance or are in the form of "half-eggs" which include a hemispherical half and a snap-on, rounded, cap. In either form, the resulting container is capable of receiving and retaining one or more selected articles. While such containers provide the advantages mentioned above, they also present certain problems. For example, due to the non-uniform peripheral shape, considerable storage space is wasted due to irregular packing. Secondly, because the curvature of an egg is not uniform, the rolling and translation characteristics of the egg will differ within a mechanical depending on its starting orientation. Accordingly, an oblong "egg" container cannot be used effectively with a new generation of visually dynamic vending machines such as those described in U.S. Pat. No. 5,833,117, issued Nov. 10, 1998 and assigned to assignee of this invention. Additionally, many capped conventional egg containers include a rounded bottom portion formed of one type of plastic (e.g., polystyrene) while the rounded lid or cap is made from another type (e.g., polypropylene) which provide different optical characteristics and feel.

The shape uniformity problem has been recognized and addressed, in part, by a spherical capsule for bulk vending has been disclosed in U.S. Pat. No. 5,064,073. However, that capsule is of a generally one piece construction with a small capped opening. The size of the opening substantially restricts the possible applications and limit the capsule to dispensing, liquid, particulate, or items so small or compressible that they can fit through the limited diameter opening.

Thus, there is a need for a spherical capsule capable of general utility and providing uniform appearance and adequate strength particularly suited for use in the vending industry.

SUMMARY OF THE INVENTION

It is therefore an object of the present invention to provide a generally spherical capsule package that overcomes shortcomings and problems of the prior art.

It is another object of the invention to provide an improved plastic capsule for general use in the packaging field.

It is another object of the invention to provide an improved bifurcated plastic capsule capable of providing standardized, spherical packaging of selected diameter and hoop strength for general use in the bulk vending field.

Still another object of the present invention to provide a bifurcated spherical capsule particularly suited for use in the bulk vending field that provides a hollow core capable of housing items having dimensions approximating the capsule's interior diameter.

A further object of this invention is to provide a capsule structure providing, at once, standardized sizes, peripheral conformation uniformity, adequate strength, structural integrity, and reusability.

Still another object of the invention is to provide a uniform capsule permitting visual observation of the packaged content.

Another object of this invention is to provide a generally spherical capsule container capable of use in existing vending machines and in dynamic discharge vending machines.

A further object of this invention is to provide a re-enterable molded, generally spherical merchandise capsule that may be conveniently, efficiently, and inexpensively packaged with minimal labor change from that required for conventional egg type packaging.

It is another object of this invention to provide for customizable packaging by allowing selection of color and clarity of the shell and which can allow for confirmation of product identity and character.

A further object of the invention is to enhance entertainment value of the vending process by permitting viewing of the item or items being dispensed.

These and other objects are satisfied by a plastic container package, featuring a first generally hollow, substantially hemi-spherical shell member formed by a wall having an annular flange element of a generally circular configuration defining a first select inner diameter and a recessed ledge. The packaging also includes a second generally hollow, substantially hemispherical shell member formed by a wall, said second member having an annular lip element with a generally circular periphery defining a surface having a diameter which corresponds to the first inner diameter and is dimensioned to cooperate with said annular flange element of said first shell member, so as to provide a frictional compression fit therewith to separably connect the first and second hemispherical members to form a substantially hollow spherical packaging container.

Further objects of the present invention are satisfied by a separable plastic globe package, comprising:

- a first generally hollow, substantially hemispherical means for said first member having an annular lip element of a generally circular configuration defining a first select inner diameter and an angled notch defining than outer peripheral surface the lip;
- a second generally hollow, substantially hemispherical member, said second member having an annular lap lip element of a generally circular configuration defining a second select inner diameter which corresponds to the first inner diameter where the lap lip is adapted to cooperate with annular notched lip of the first member is provide a compression fit to join the first and second hemispherical members into a substantially hollow spherical packaging container.

This invention also provides a method of packaging goods in the spherical capsule package.

As used herein, "generally spherical" is intended to embrace its ordinary meaning and in the context of the instant invention, allows for some deviation from spherical which may occur by design or as a result of machining, materials, and other variables. The expression is intended to define the functionality where the package can roll with substantial regularity along a linear track and thus, be characterized as spherical. Correspondingly, the word "hemi-spherical" is intended to embrace geometric configurations that are both truly hemispherical as well as those approaching hemispherical. In the context of this invention, where the capsule components can be generally characterized as bifurcated and permit containment of objects having lengths approaching the diameter of the capsule interior, such structures are intended to fall within the meaning of hemi-spherical.

Given the following enabling description of the drawings, the inventive generally spherical capsule package particularly suited for use in connection with bulk vending machines should become evident to a person of ordinary skill in the art.

BRIEF DESCRIPTION OF THE DRAWINGS

FIG. 4 is a detail (inverted) cross-sectional view of the mating component edges of the embodiment illustrated in FIG. 1.

FIG. 5 is a cross-sectional view of mated component edges another embodiment of the invention.

DETAILED DESCRIPTION OF THE PREFERRED EMBODIMENT

Figure 1:
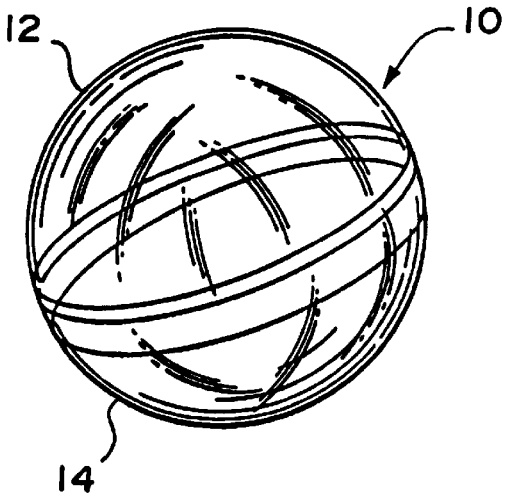
FIG. 1 is a perspective view of a spherical capsule package according to the invention.

FIG. 1 illustrates a novel, generally spherical, bifurcated capsule 10 according to the present invention. The capsule 10 is established by the friction or interference fit of the upper hemisphere 12 with the lower hemisphere 14. The capsule hemispheres 12 and 14 are formed from injection molded, clear color, and transparent 2–10 mil polystyrene. Preferably, the walls are about 3 mil thick except along the equatorial band 16 where the thickness may increase to 6 or more mils (See FIG. 2).

The equatorial band 16 is established by the mating of the hemispheres. The band 16 is comprised of two segments; the annular lip 18 associated with the upper hemisphere 12 and the receiving flange 20 and angled rim 22 of the lower hemisphere 14. The lip 18 defines different curvatures along the interior and exterior walls from each other and from the remainder of the hemispherical shell. Likewise, the rim 22 exhibits different curvatures between the interior and exterior surfaces which are generally less than that of the remainder of lower hemispherical shell. However, the curvature of the exterior of lip 18 and that of the rim 22 preferably are nearly the same.

Figure 2:
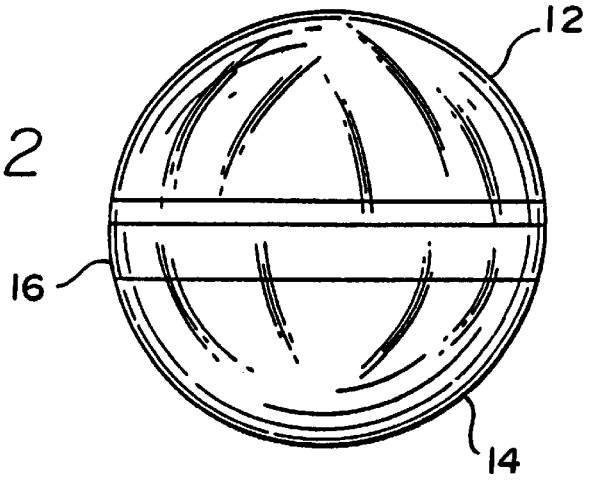
FIG. 2 is side view of the embodiment illustrated in FIG. 1.
Figure 3:
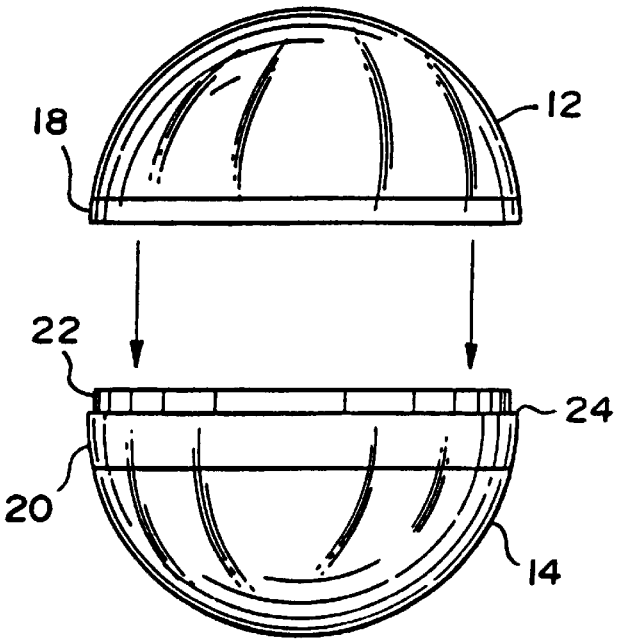
FIG. 3 is an assembly view detailing the two components of the embodiment illustrated in FIG. 1.

In FIGS. 3 and 4, the assembly of an exemplary 2 inch capsule is illustrated. The annular lip 18 which includes an angled interior face 19 of approximately 5°, is pressed onto and received by the receiving flange 20 which fictionally engages the angled surface of the rim 22 of the hemisphere 14. The assembled container illustrated in FIGS. 1 and 2 is complete when the the face 13 of the lip 18 abuts stop ledge 24.

The process of establishing the friction/interference fit between the mating hemispherical sections 12 and 14 is facilitated by features to both provide guidance, and to improve strength and assembly integrity while providing non-destructive separability. In the illustrated embodiment, the face 13 of the lip 18 first engages the bevel 28. Although the bevel 28 is not necessary for the practice of the invention, it facilitates assembly of the hemispheres by providing an alignment guide and camming surface. During compression, the face 13 cams against the rim 22. Thus, lip 18 is be urged radially outwardly as projecting rim 22 is urged radially inwardly by a corresponding degree. Once the face 13 passes the base of the beveled surface 28, the cooperating mating angles of the rim 22 and the lip 18 serve to urge the face into an abutting relation with the stop ledge face 24. The cooperating inclined surfaces produce a snap/friction fit effect of the two hemispheres and provide a confident interlock thereof while correspondingly providing full dimensional access to the interior of the capsule 10.

In order to facilitate non-destructive separability, i.e., reopening, of the container, the curvatures may vary to provide an interference fit feature, between the respective mating faces 22 and 19. A slightly imperfect fit both minimizes the possibility of inadvertently producing an "optical" fit and provides a very small gap along the opposing faces to promote separability. Consequently, it is desirable to incorporate slight variations in the angles of the respecting juxtaposed faces of the lip 18 and the rim 22. However, this degree of separation should be minimal so much as to avoid adversely impacting the integrity of the interference fit between the hemispheres. In a 2 inch capsule, the separation is on the order of hundredths or even thousandths of an inch. By including the "interference fit" feature, the invention provides for multiple re-entries and therefore, reusability of the novel spherical containers.

The invention also is readily adaptable to an number of variations. As depicted in FIG. 5, one such variation includes a beveled or tapering end-face 32 on the lip 18 which corresponds to and is adapted to engage the bevel 28 on the rim 22. Also the exterior surface of the upper hemisphere 12 incorporates a finger grip notch 30. The notch 30 can circumscribe all or part of the circumference of the lip 18 and preferably has a thickness corresponding to the depth of an average fingernail, etc. To separate the hemispheres, a person will grip the spherical capsule 10 and insert fingernails into the notch 30 disposed around the circumference of the capsule. By pulling the hemispheres in opposite directions with sufficient force to overcome the hoop force of the interference fit, the faces 19 and 24 translate along one another until cleared of one another when the hemispheres are separated.

It should be apparent to the skilled artisan, that any appropriate shell forming composition may be used to establish a capsule so long as it provides sufficient hoop strength at the overlap to retain the structural integrity of the sphere during a range of forces to which the capsule would be subjected in a typical vending application. For example, translucent or opaque moldable cellulose or cellulose byproducts can be used to form spherical capsules in place of the clear, transparent plastics depicted in the drawings. Although visual access to the contents may be impaired or eliminated, the environmental advantages of using such biodegradable containers may offset that disadvantage.

The design variations are essentially unlimited so long as the design provides a bifurcated generally spherical packaging contour and adequate strength to maintain the packaging integrity during storage and dispensing.

Given the foregoing, variations and modifications to the invention should now be apparent to a person having ordinary skill in the art. These variations and modifications are intended to fall within the scope and spirit of the invention as defined by the following claims.

We claim:

1. A plastic container package, comprising:

a first generally hollow, substantially hemi-spherical shell member formed by a wall having an annular rim element defining a cylindrical thickening annulus of a select length with a first end associated with a recessed ledge and a second end, said annular rim thickening from said first end toward said second end, said annular rim element having a generally circular configuration with a substantially smooth inner surface and a second outer substantially smooth surface;

a second generally hollow, substantially hemi-spherical shell member formed by a wall, said second member having an annular lip element with a generally circular periphery defining a surface corresponding in dimension and diameter to cooperate with the smooth inner surface of said annular rim element of said first shell member, said annular lip element adapted to juxtapose and overlap said angled outer surface of said rim element of said first shell member to establish an interference fit between said lip element of the second shell member and said rim element of the first shell member, so as to provide a frictional compression fit established by camming engagement to separably connect the first and second hemispherical members to form a substantially hollow spherical packaging container providing enhanced resistance to random separation of the first and second shell members.

2. The plastic package of claim 1 where the rim element has an end face which includes a tapering bevel adapted to facilitate guiding and engaging of the first shell member with the second shell member.

3. The plastic package of claim 1 where the bevel tapers inwardly and the camming engagement of the rim element and the lip element possesses adequate hoop strength to maintain engagement of the first and second shell members during vending.

4. A plastic container package, comprising:

a first generally hollow, substantially hemi-spherical shell member formed by a wall having an annular rim element of a generally circular configuration defining an outwardly facing surface of a first select diameter and a recessed ledge;

a second generally hollow, substantially hemi-spherical shell member formed by a wall, said second member having an annular lip element with a generally circular periphery defining an interiorly facing surface having a diameter which corresponds to the first select diameter and is dimensioned to cooperate with said annular rim element of said first shell member so as to provide a frictional compression fit therewith to separably connect the first and second hemispherical members to form a substantially hollow spherical packaging container where the first and second members are formed of injection molded polystyrene and where the polystyrene is of a thickness ranging from 2 to 10 mils.

5. The plastic package of claim 4 where the polystyrene is of a thickness of 3 to 6 mils.

6. The plastic package of claim 5 where the wall thickness of the first shell member and the wall thickness of the second shell member are substantially equal.

7. The plastic package of claim 5 where the first and second wall thickness are equal and both the annular rim element and annular lip element are complementarily beveled where the annular rim element progressively thickens from the ledge to an end and the annular lip element thickness increases progressively from a base to an end to provide a reversible frictional interference fit between the first and second shell members when assembled.

8. The plastic package of claim 5 where the first shell member has a substantially constant exterior first radius of curvature, the annular rim element of the first shell member defines a second radius of curvature, the second shell member has a third radius of curvature substantially equal to that of the first radius of curvature and the annular lip element has a fourth radius of curvature.

9. The plastic package of claim 8 where the first, third and fourth radii of curvature are substantially equal.

* * * * *